US005283978A

United States Patent [19]

Horgan, Jr.

[11] Patent Number: 5,283,978

[45] Date of Patent: Feb. 8, 1994

[54] GLASS DOOR AND HINGING MECHANISM WITH METHOD OF INSTALLATION

[75] Inventor: William J. Horgan, Jr., New Smyrna Beach, Fla.

[73] Assignee: Blumcraft of Pittsburgh, Pittsburgh, Pa.

[21] Appl. No.: 807,081

[22] Filed: Dec. 13, 1991

[51] Int. Cl.[5] ..... E05D 7/08

[52] U.S. Cl. ..... 49/388; 49/501

[58] Field of Search ..... 49/381, 388, 358, 390, 49/501; 52/821, 829

[56] References Cited

U.S. PATENT DOCUMENTS

| | | | |
|---|---|---|---|
| D. 218,809 | 9/1970 | Horgan . | |
| D. 267,274 | 12/1982 | Horgan . | |
| D. 267,275 | 12/1982 | Horgan . | |
| D. 289,201 | 4/1987 | Weeden et al. . | |
| 2,987,782 | 6/1961 | Kurowski | 49/386 |
| 3,191,214 | 6/1965 | Protzman . | |
| 3,325,942 | 6/1967 | Bejarano | 49/388 |
| 3,373,529 | 5/1968 | Ingham | 49/381 |
| 3,390,486 | 7/1968 | Walters | 49/381 |
| 3,418,755 | 12/1968 | Di Chiaro | 49/501 |
| 3,583,464 | 6/1971 | Johnson . | |
| 3,653,156 | 4/1972 | Horgan, Jr. | 49/501 |
| 3,662,429 | 5/1972 | Johnson et al. | 49/381 |
| 3,828,394 | 8/1974 | Horgan, Jr. | 49/388 |
| 3,964,207 | 6/1976 | Peterson . | |
| 4,006,569 | 2/1977 | Kain . | |
| 4,523,414 | 6/1985 | Horgan . | |
| 4,534,395 | 8/1985 | Carroll . | |
| 4,956,954 | 9/1990 | Horgan, Jr. | 49/388 |
| 5,129,184 | 7/1992 | Fish | 49/478 |

FOREIGN PATENT DOCUMENTS 2301674 9/1976 France .

OTHER PUBLICATIONS

Tempered Glass Door Catalogue B-86 (Blumcraft of Pittsburgh, Pa. 1986) p. 8.

Tempered Glass Door Catalogue B-92 (Blumcraft of Pittsburgh Pa. 1991) pp. D-4 through D9.

Where Have All the Fittings Gone? (Blumcraft of Pittsburgh, Pa. 1990).

Tempered Glass Door Catalogue B-89 (Blumcraft of Pittsburgh, Pa. 1989) pp. D3, D7, D9, D11, D12, D23.

*Primary Examiner*—Peter M. Cuomo
*Assistant Examiner*—Michael Milano
*Attorney, Agent, or Firm*—Paul & Paul

[57] ABSTRACT

A glass door and hinging mechanism where a glass panel may have a frame disposed entirely outside of the panel surface and perimeter of the panel which is held to the panel edge by a zone of bonding material, the glass door frame being provided with mounting members for receipt in hinging mechanism assemblies which are positioned above and below a doorway.

31 Claims, 7 Drawing Sheets

GLASS DOOR AND HINGING MECHANISM WITH METHOD OF INSTALLATION

BACKGROUND OF THE INVENTION

1. Field of the Invention

This invention relates to doors and hinging assemblies for use in doorway systems.

2. Brief Description of the Prior Art

Present architectural applications rely on the use of glass doors in the design of modern buildings. The use of glass panels in a door is often employed, wherein a variety of hardware must first be attached to the glass itself in order to securely mount the panel in a doorway. Once secured to a glass panel, the mounting hardware may be connected to a doorway or other support, such as for example a closer mechanism, in order to install the door in its position within the doorway.

The glass panels required for use as doors are usually heavy due to the strength requirement necessary to ensure safety from breakage during operation. Therefore, the more a door must be moved around by a crew of workers during installation the more difficult and awkward the task of installing a door becomes. This holds true for both the original installation process and any subsequent times when repairs to the closer mechanism are necessary. Such repairs mandate that the entire glass door be removed in order to access the closer mechanism.

In existing glass walls it has become possible to mount fixed panels or side-lights with minimal evident hardware interrupting the view through the glass. It has been possible even to mount the glass directly into the building structure. However, the glass doors used in such glass walls have necessarily included some means for pivotally mounting the doors in the building structure. Such hardware has been reduced or disguised by including it within a shoe or strip along the top and/or bottom of the door, or by reducing it to a box only large enough to cover the hardware. In either case, the hardwareholding element is aesthetically inconsistent with the seethrough character of the glass wall.

SUMMARY OF THE INVENTION

The present invention provides a glass door and hinging mechanism wherein a glass panel is held in place within a door frame using a thin layer or zone of adhesive or bonding medium. When the door is opened or closed, force is transmitted from the glass panel to its frame entirely in shear, in contrast to prior art glass door assemblies in which the frame extends around the edges, and at least a portion of the force extended in the glass panel is transmitted to the frame through the faces of the glass panel.

The door frame is provided with projecting opposed pivot members which are attached to opposite edges of the door frame and are adapted to be received within members of a hinging mechanism, thereby permitting full rotation of the glass door about the pivot members. The mounting hardware provided by the invention enables the door to be mounted in a mounting structure including a standard door closer mechanism, and further, enables the door to be adjusted within the mounting space provided by the mounting structure.

A principal object of the present invention is to provide a glass door in which all mounting hardware is located outside the perimeter of the door frame.

It is another object of the present invention to provide a novel glass door and hinging mechanism and a method of installation.

It is a further object of the present invention to accomplish the above objects wherein the door frame and the glass panel are of a uniform thickness.

It is another object of the present invention to provide a glass door frame with self-contained pivot means.

A further object of the present invention is to provide a glass door and hinging mechanism for use with sidelight panels, where the glass door and sidelight thickness may be the same.

Another object of the present invention is to provide a header means in which both door mounting hardware and sidelight mounting hardware may be concealed.

These and other objects and advantages of the present invention will be readily apparent to those skilled in the art by reading the following brief description of the drawings, detailed description of the preferred embodiments and the appended claims.

DETAILED DESCRIPTION OF THE PREFERRED EMBODIMENTS

Figure 1:
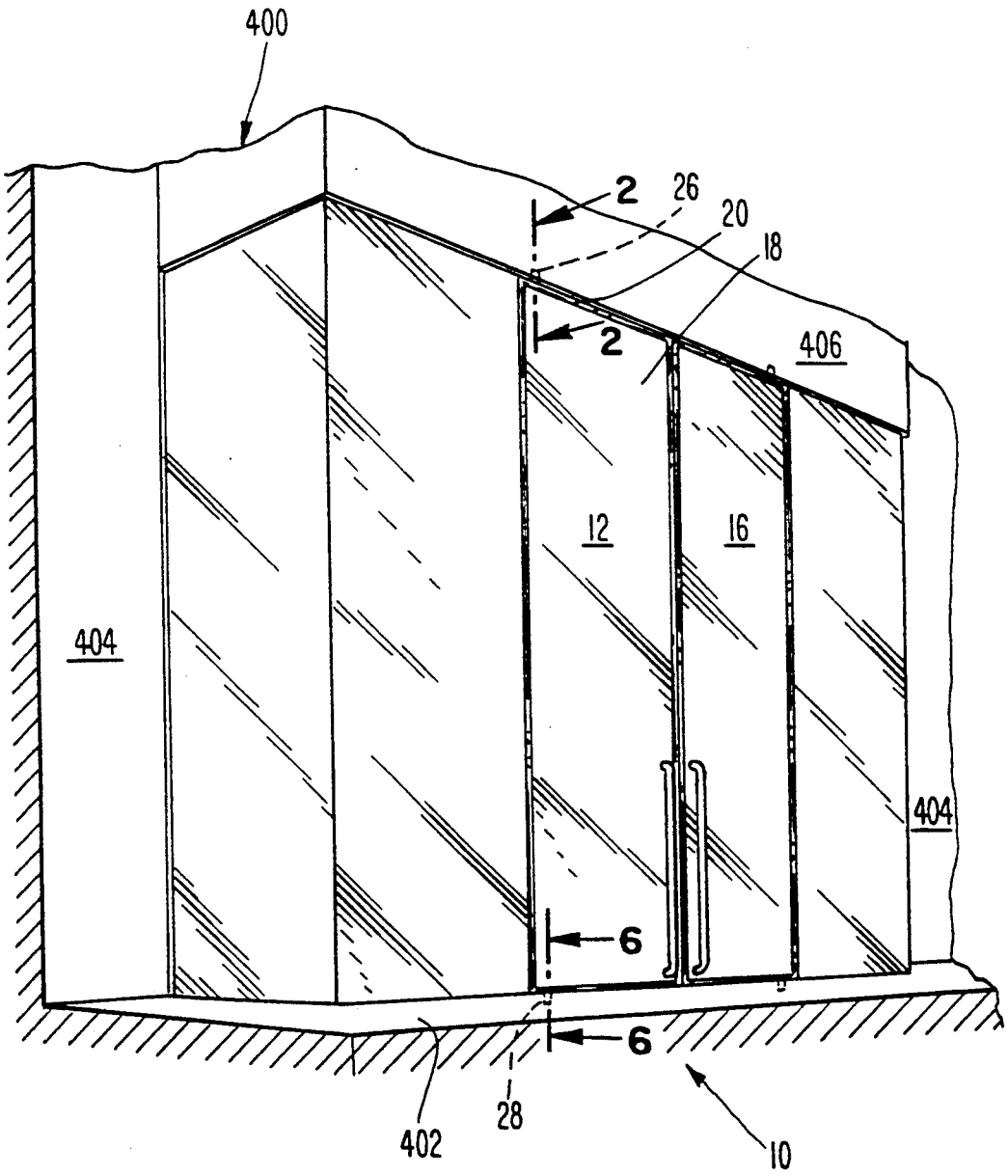
FIG. 1 is a perspective view showing a glass door assembly according to the present invention in use on the front of a building.

Referring now to the drawings in detail, wherein like reference numerals indicate like elements in each of the several views, reference is first made to FIG. 1 wherein there is shown a glass door assembly 10 according to the present invention including a glass door 12, and a hinging mechanism 14 (FIG. 2) for mounting the door 12. The glass door 12 and associated hinging mechanism 14 may be employed on, the exterior of building facades such as that 400 shown in fragmentary view in FIG. 1. The building facade 400 is shown, for example, having a floor 402, a pair of opposite side walls 404, and an upper supporting structure, such as the front face 406, which may, for example, be a ceiling, soffit, or any like structure which will support the hinging mechanism 14 and the glass door 12. In FIG. 1 the hinging mechanism 14 is not visible, because, once installed, it preferably is hidden to remain out of view during normal operation of the door 12. Although one door 12 will be referred to throughout this description, it will be understood that a second door 16, or other doors can be provided according to the present invention.

Figure 2:
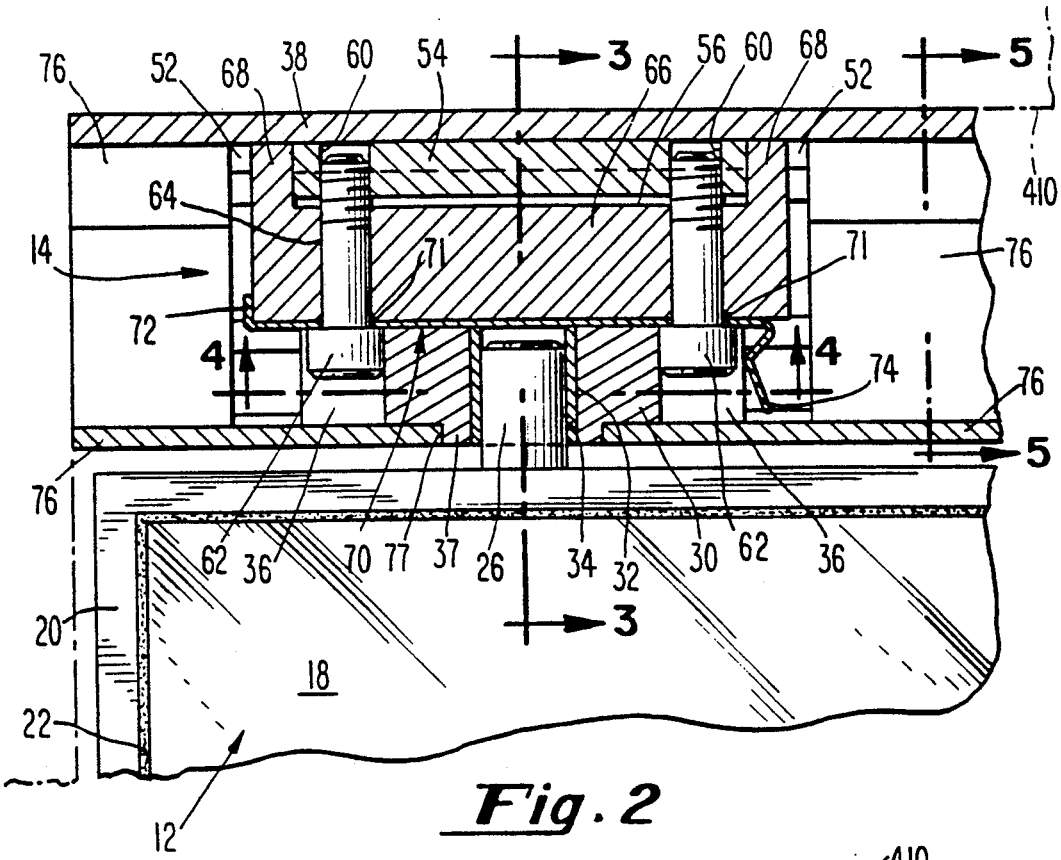
FIG. 2 is an enlarged front cross-sectional view of the upper hinging mechanism of the glass door assembly of FIG. 1 taken along the line 2—2, with the glass door assembly shown in fragmentary view.

The glass door 12 comprises a glass panel 18 supported by a door frame 20 (shown enlarged in a fragmentary view in FIG. 2). The glass panel 18 is held in place by a thin layer or zone of bonding material 22 applied between the interior edges of door frame 20 and the perimetric edges of the glass panel 18. The bonding material 22 may comprise any substance having adhesive properties suitable for securely bonding to both glass and metal surfaces, such as, silicone resin-based adhesives. The bonding material 22 provides strength for holding the glass panel 18 in place, and in addition is resilent and provides shock absorbing means when forces, such as vibrational, are transmitted to the door 12.

Preferably, the door frame 20 is comprised of stainless steel for both appearance and durability; however, other materials may be used for the door frame construction provided they are of suitable strength for retaining and supporting the glass panel 18.

Figure 6:
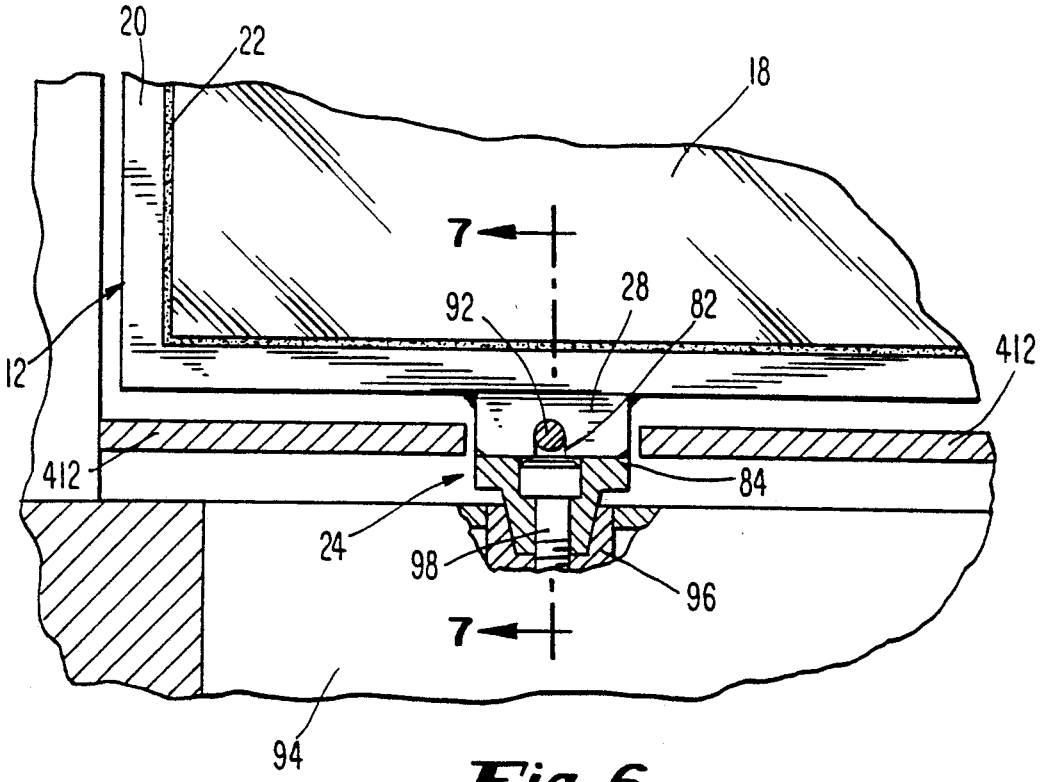
FIG. 6 is an enlarged front cross-sectional view of the lower hinging mechanism of the glass door assembly of FIG. 1 taken along the line 6—6, with the glass door assembly being shown in fragmentary view.

The glass door 12, while shown having a framed perimeter, can be provided with only three sides of the door framed, or with only two sides of the door framed; the two framed sides being opposite sides for connection to upper and lower hinging mechanisms 14 and 24 (FIG. 6). The frame provided on a side of the door need not extend over the entire glass panel edge, but rather may cover only a portion of a panel edge. This installation, of course, would be subject to panel strength and weight being accommodated by the frame structure.

Figure 3:
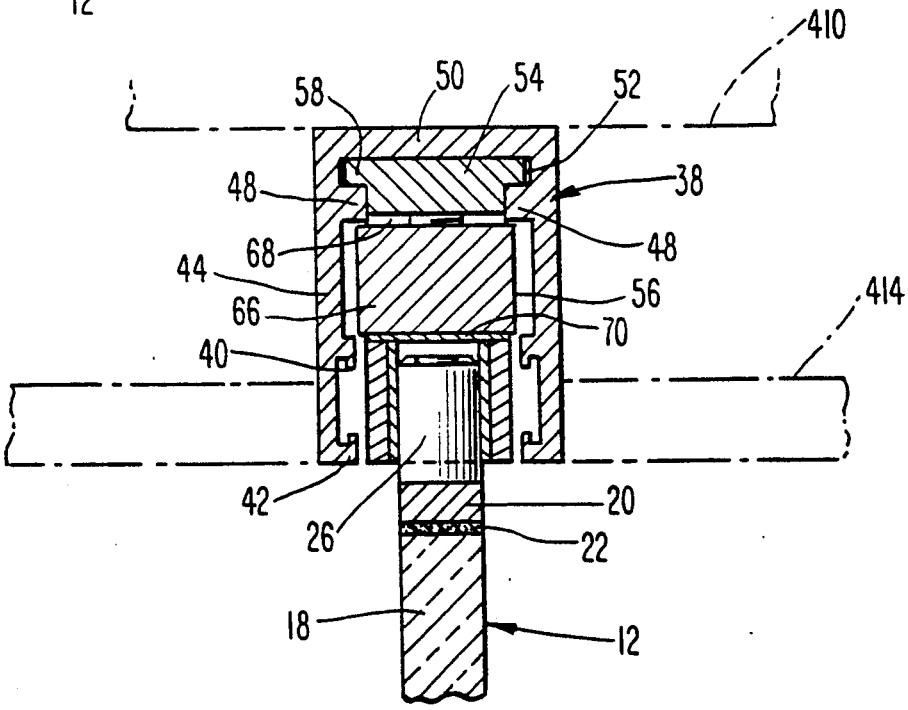
FIG. 3 is a right side cross-sectional view of the upper hinging mechanism of FIG. 2 which is shown mounted in a ceiling (seen in phantom), taken along the line 3—3.

An upper pivot member 26 (FIG. 2) and lower pivot member 28 (FIG. 6) are provided on opposite sides of the door frame 20. The pivot members or pintels 26, 28 are shown extending outwardly from the exterior door frame edges. The upper pivot member 26 preferably is provided having a pin-like configuration, while the lower pivot member 28 preferably is provided having a bar-shaped configuration. Furthermore, it is preferred that both the crosssectional diameter of upper pivot member 26, and the width of lower pivot member 28 are provided so as not to be less than the thickness of the door frame 20, as shown in the view of FIG. 3.

Figure 4:
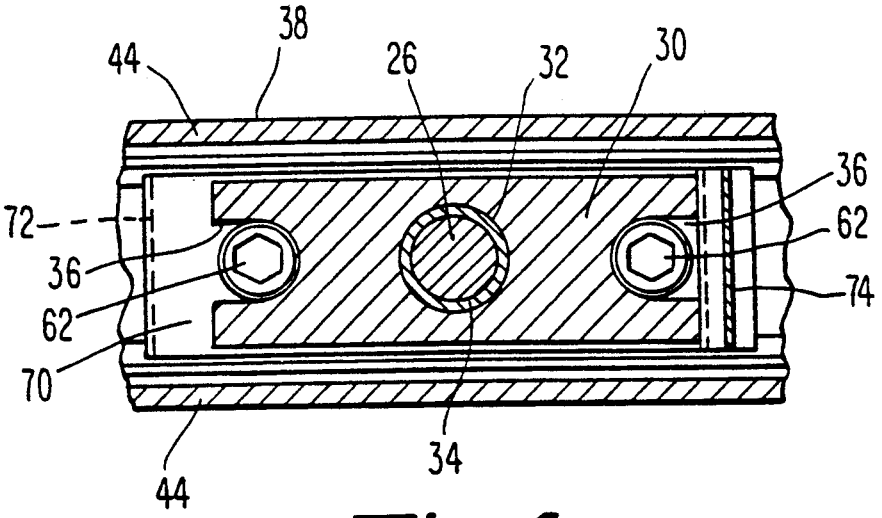
FIG. 4 is a bottom cross-sectional view of the upper hinging mechanism of FIG. 2 taken along the line 4—4.

FIG. 2 shows the upper hinging assembly 14. A pivot block 30 is provided having a center bore 32 for receiving a cylindrical bearing 34 therein. The upper pivot member 26 is seated within the bearing 34, which allows the pivotal movement of the glass door 12 about the axis of pivot member 26. A concavity 36 having a generally U-shaped configuration is provided at each end of the pivot block 30 (FIGS. 2 and 4). The pivot block 30 is preferably provided with collar portion 37, which is shown extending from the lower portion of the block 30 and surrounding a portion of the bearing 34.

Figure 5:
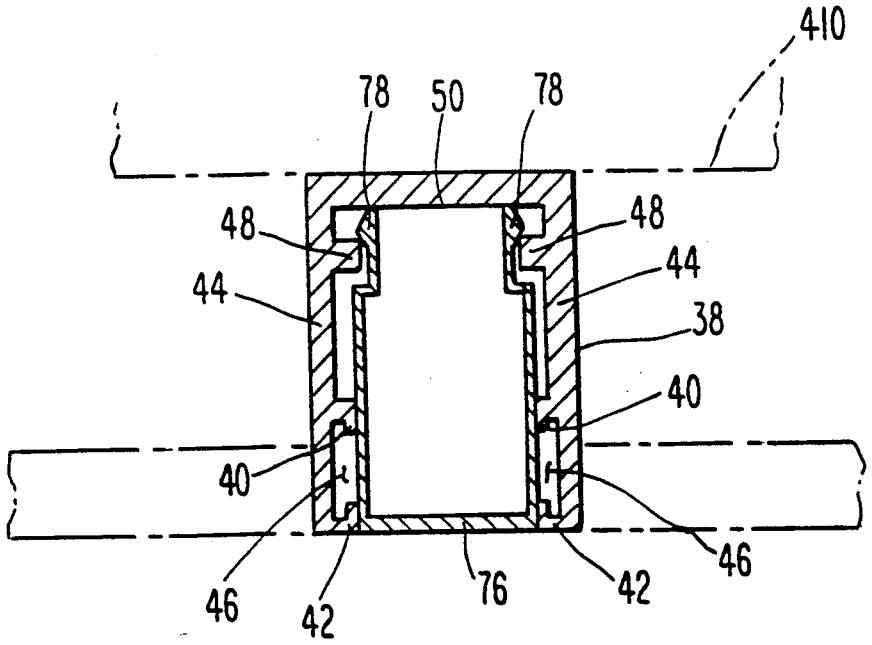
FIG. 5 is a right side cross-sectional view of the header of FIG. 2 with the cover piece installed therein taken along the line 5—5.

A housing, such as the header or track 38 seen in FIG. 5, shown mounted to a support 410 (in phantom) above a ceiling 414 (in phantom) is provided for retaining the components of the upper hinging assembly 14. The header 38, for example, can be provided as a single section for accommodating a single hinging assembly therein, or can be provided in extended length to comprise a track whereupon more than one hinging assembly can be mounted for installation of a pair, or several glass doors in linear relation to one another.

Preferably, the header 38 comprises pairs of opposing "L"-shaped projections 40 and 42 extending inwardly from each of the housing side walls 44 into the interior of the header 38 to define a pair of opposing pockets 46. A pair of opposing inwardly directed protrusions 48 are provided on the upper portion of the side walls 44 of the housing 38 and define a slot 52 with the side walls 44 and top wall 50.

The upper hinging assembly 14, seen best in FIG. 2, further comprises a T-shaped bar member 54 and a retaining block member 56 which are also carried within the header 38. The bar member 54 and the block member 56 are positioned above the pivot block 30. The T-shaped bar member 54 (FIG. 3) is provided with a pair of arms 58 each of which rests in a respective slot 52 of the header 38, and are supported by respective upper protrusions 48 of the header 38. As shown in FIG. 2, securing means, which preferably comprise a pair of threaded apertures 60, are provided in the T-shaped bar member 54 for receiving a matingly threaded end of a bolt or screw 62 therein to facilitate installation of the retaining block 56 within the header 38.

A retaining block member 56 is provided with a pair of bores 64 extending vertically entirely therethrough, which align with the apertures 60 of the bar member 54 when the bar and block members 54 and 56, are installed. The retaining block member 56 is comprised of a generally rectangular body portion 66, having a pair of side wall portions 68 extending upwardly from the body portion 66 at each end thereof. Preferably, the block member side walls 68 are each slightly smaller in width than the width of the body portion 66 from which the side walls 68 extend, as best seen in FIG. 3. When installed within the header 38, the block side walls 68 extend above the header projections 48 which form the upper track slots 52 while the body portion 66 of retaining block member 56 remains below the projections 48.

A spring member 70, seen best in FIG. 2, is provided between the retaining block member 56 and the pivot block 30 to prevent lateral shifting of the pivot block 30. The spring member 70, is preferably comprised of a spring steel material, and is provided with a pair of apertures 71 through which are received respectively associated securing means, or bolts 62. Flanged portions 72 and 74 are provided at each end of the spring member 70. An upper flange 72 is provided to engage a side of the retaining block 56. The lower flange 74 has a bent wall which when mounted with the bolts 62 provides a support against which an end of the pivot block 30 is maintained. The spring member 70 operates to secure the pivot block 30 from lateral movement by engaging the pivot block 30 at on end and urging the block 30, via a cut-out portion 36, against one of the bolts 62.

Referring to FIG. 2, snap-in cover pieces 76 are provided to cover the bottom of the upper hinging assembly 14, in particular, that portion visible when viewing the assembly 14 from the bottom. The cover pieces 76 are snapped into position within the header 38 to cover the bottom surface of pivot block 30. Preferably, the cover pieces 76 are each provided with a cut-out portion 77 which accommodates the collar portion 38 of the pivot block 30 when installed. As shown in FIG. 5, each cover piece 76 may, for example, be provided with a pair of raised ridges 78 running along the upper edges of the cover piece 76. The ridges 78 are received in the slots 52 of the header 38 in order to secure the covers 76 in place.

Referring to FIG. 6, the lower hinging mechanism 24 is shown enlarged and in cross-section with the door 12 and lower pivot member 28 shown in the fragmentary front view. The lower pivot member 28 preferably comprises a bar-shaped member which is connected to the bottom edge of door frame 20 by welds 80, or any other suitable attachment means. The pivot member 28 is provided with a notch 82 disposed in its lower surface. The notch 82 extends entirely through the thickness of the lower pivot member 28, as shown by the cross-sectional view in FIG. 7. A door closer adapter 84 is provided to receive and carry the lower pivot member 28 therein.

Figure 7A:
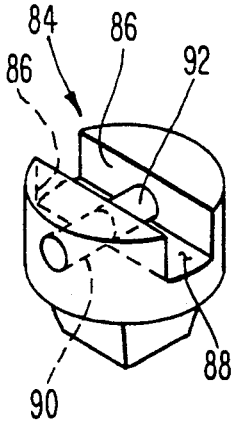
FIG. 7A is a perspective view of an adapter member of the lower hinging mechanism of FIG. 7 shown apart from the lower hinging mechanism.
Figure 7:
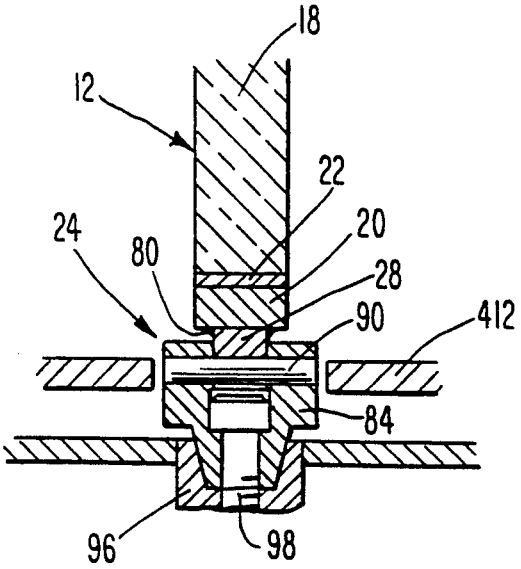
FIG. 7 is a left side cross-sectional view of the lower hinging mechanism of FIG. 6 taken along the line 7—7.

Referring to FIG. 7A, the adapter 84, is shown in a perspective view provided having a pair of opposing side walls 86 which define the sides of a generally U-shaped channel 88 therebetween in which the lower door pivot member 28 (FIG. 7) rests, when installed. The adapter side walls 86 are provided with a bore 90 extending entirely through each wall for accommodating a pin member 92 therein. The pin 92 can be installed after the lower door pivot member 28 has been inserted into the closer adapter 84 to permit an adequate amount of space for receiving the door 12 within the hinging mechanisms 14 (FIG. 2) and 24. However, if space permits, the door 12 may be mounted with the pin 92 already installed within the adapter 84.

A door closer 94 is shown schematically in FIG. 6. The closer 94 can be any of the standard types such as those incorporating a hydraulic closer mechanism which are commercially available for use in door hinging applications. The door closer adapter 84, for example, can be carried in a socket 96 of the door closer 94. A spindle 98 is shown extending through the center of the closer adapter 84 and into the door closer 94. The spindle 98, for example, can be attached to a hydraulic mechanism (not shown) within the closer 94 for enabling reciprocal swinging movement of the glass door 12.

The installation method involves mounting the housing or header 38 on a supporting structure 410 (shown in phantom in FIGS. 2, 3 and 5) which may comprise a beam, joist, or other suitable like structure. The housing 38 can be provided with apertures (not shown) which permits nails or screws to be used to fasten the housing 38 to the support 410. A variety of shims (not shown) having various thicknesses can be placed between the housing 38 and support 410, if needed, in order to position the housing 38 at a suitable level for maintaining the desired position of the glass door 12. It is noted that the housing 38 can be secured to the support 410 by a variety of other intermediary members (not shown).

The door closer 94 (FIG. 5) is positioned beneath the door sill or threshold 412, and rests on a supporting surface (not shown). The sill 412 can be installed before or after the installation of the glass door 12.

If the hinging assembly is employed using the lower closer mechanism (FIGS. 1–8), the closer is preferably installed on a supporting surface located beneath the floor 402 and/or threshold 412. The adapter 84 can then be installed within the door closer 94.

The bar member 54 is then prepositioned within the header 38, its arms 58 being supported by the header projections 48 (see FIG. 3). The bar member 54 may be slid to a remote area within the header 38, and may later be slidably positioned over the pivot block 30 once the lower door pivot member 28 is installed into the lower hinging mechanism 24. However, if space permits, the bar member 54 can be installed at one end of the header 38 and slid over the pivot block 30 after the pivot member 84 is received by the lower hinging mechanism 24.

The glass door 12 is mounted by first placing the pivot block 30 containing the bearing 34 (shown in FIGS. 2 and 3) over the upper door pivot member 26 which extends from the door frame 20. The door 12, with the pivot block 30 in place, is then lifted into the header 38 until the lower pivot member 28 clears the door closer adapter 84, then the glass door 12 is lowered so that the lower door pivot member 28 rests within the adapter 84, and the notched portion 82 of the lower pivot member 28 is resting on the pin 92 of the adapter 38. The pin 92 remains in position to guard against excessive lateral shifting of the glass door 12.

With the pivot block 30 on the door 12, and resting within track 38, a T-shaped bar member 54 and retaining block member 56, are then slid within the header 38 and are positioned over the pivot block 30. The spring member 70 is preferably placed on the block 56 as it is slid into position over the pivot block 30, or if space permits, can be inserted between the retaining blocks 56 and pivot block 30 before fastening the assembly with the bolts 62.

Each of the cover pieces 76 shown in FIGS. 3 and 5, can be installed by positioning it below the pivot block 30 and then snapping it into position within the header 38 so that the ridges 78 are received within a respective upper track slot 52. Alternatively, the cover pieces 76 may be slid into position by inserting the pieces at an open end of the header 38. However, even when snapped into position, the present construction permits the closer pieces 76 to be slidingly positioned within the header 38.

Figure 8:
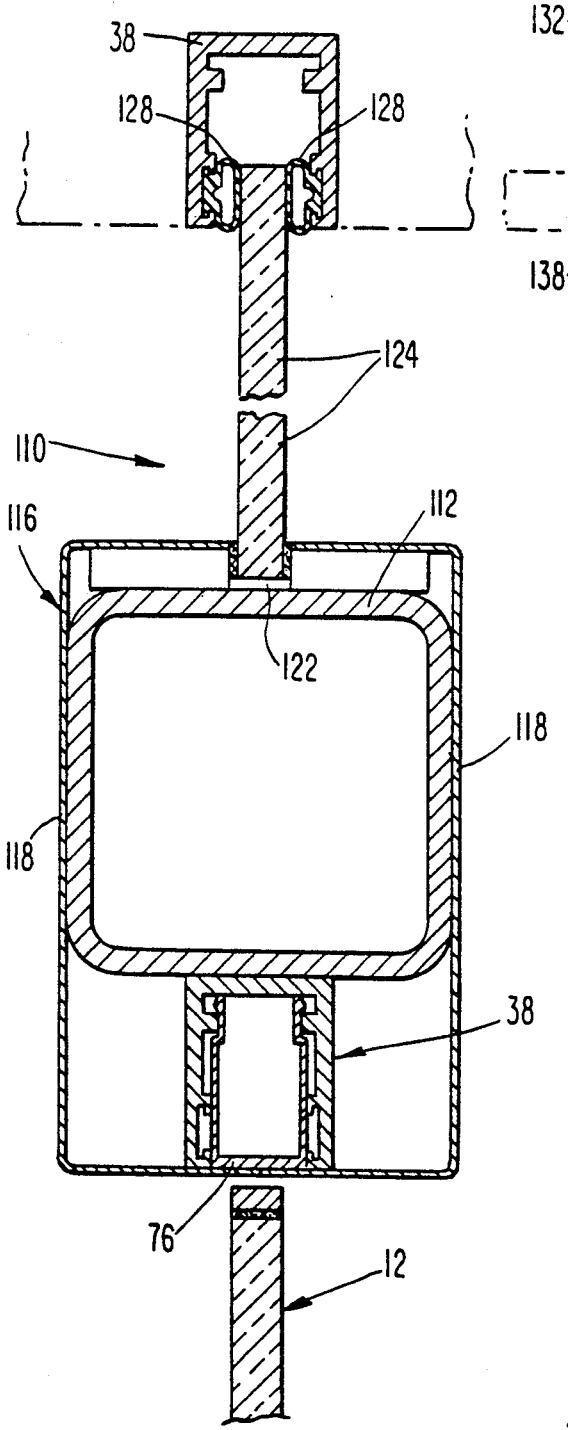
FIG. 8 is a side cross-sectional view of a second embodiment of the glass panel assembly of the present invention shown supporting a transom panel above, and a glass door below.

A second embodiment of the present invention employing a different header assembly 110 is shown in FIG. 8, having a hollow bar member 112, a housing 38, such as that shown in FIG. 2, for accommodating a hinging assembly (not shown), and an outer cover 116 having a pair of side walls 118. The upper portion of the header assembly 110 is provided with a generally "U"-shaped channel 122 for receiving an edge of a transom glass 124 therein. An upper housing member, such as the header 38, is also provided, with bracing members 128 which receive the upper end of the transom glass 124 therein. The glass door 12, which may have construction as described herein, is provided to operate with the assembly 110 in a manner similar to the door 12 described herein. In addition, cover members 76 can also be employed with this alternate embodiment 110, as shown.

Figure 9:
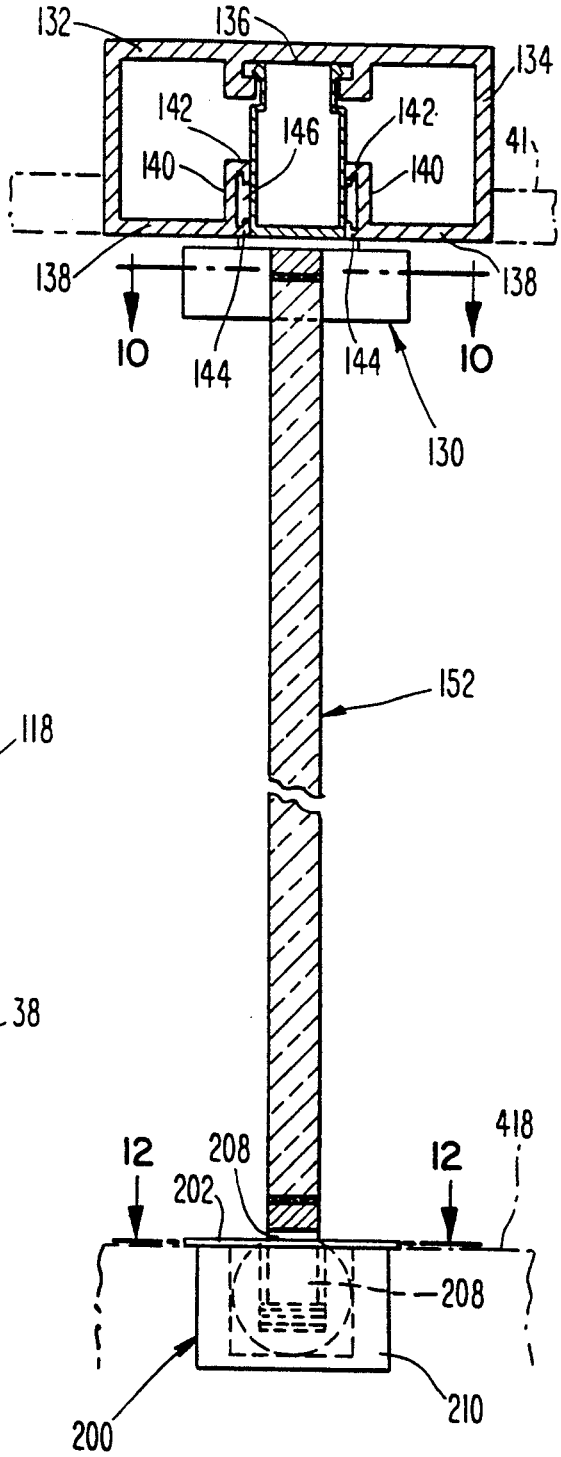
FIG. 9 is a side cross-sectional view of a third embodiment of the glass door assembly of the present invention shown with an overhead closer mechanism.

FIG. 9 shows a side cross-sectional view of another embodiment of the present invention employing hinging assembly 130 for use with an overhead door closer mechanism. The closer itself (not shown) may be any of those generally commercially available which are suited for such applications. A header 132 is provided for housing the overhead door closer (not shown). The preferred header embodiment 132 is shown comprising a pair of opposing side walls 134, an upper wall portion 136 which connects sidewalls 134, and a pair of lower walls 138. Each lower wall 138 extends from the lower edge of a respective sidewall 134 at a right angle therefrom, and is inwardly directed in relation to a respective sidewall 134. Extending upwardly and at right angles from each lower wall 138 is an inner wall portion 140. Each inner wall portion 140 is furnished with "L"-shaped projections 142 and 144 which extend outwardly from the inner walls 140 to form a pair of pockets 146.

The closer mechanism (not shown) is mounted in the header 132 and is hidden above the ceiling 414 (shown in phantom). A spindle 150 (FIGS. 10 and 11) extends from the closer mechanism into the upper hinging assembly 130. The hinging assembly 130 is installed about the spindle 150 to enable the door 152 (which can be constructed similar to door 12 described herein) to open and/or close when the spindle 150 is rotated by the closer.

Figure 10:
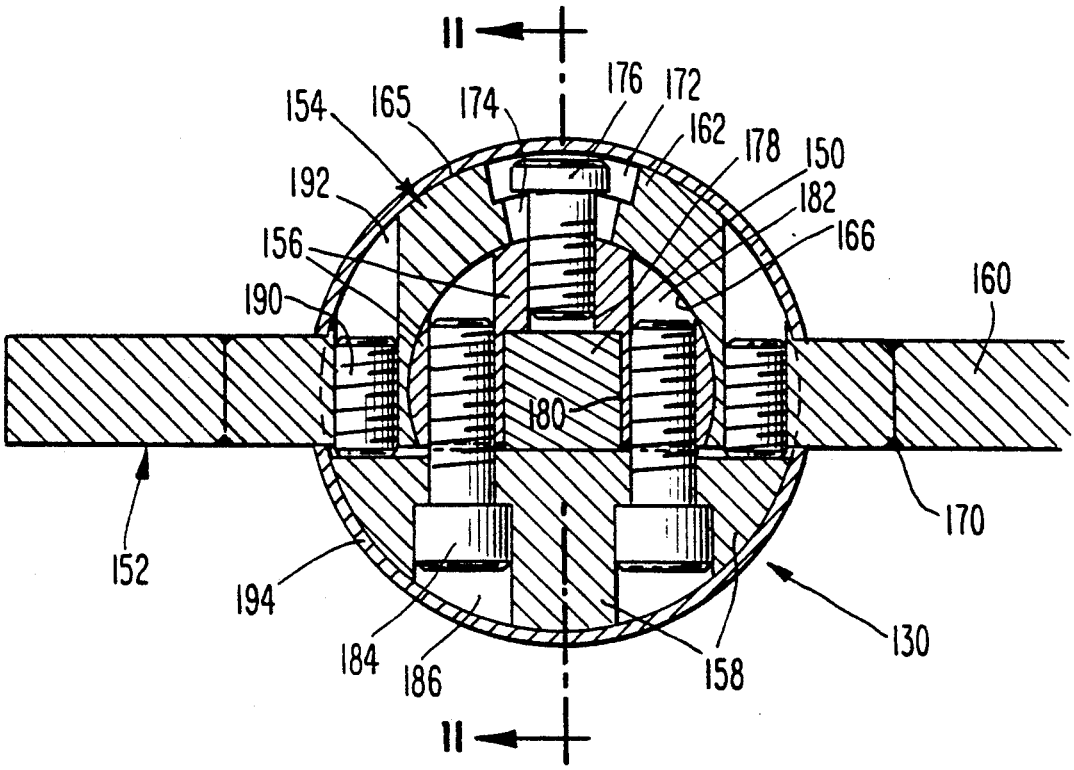
FIG. 10 is an enlarged cross-sectional top view of the glass door and assembly of FIG. 9 taken along the line 10—10.
Figure 11:
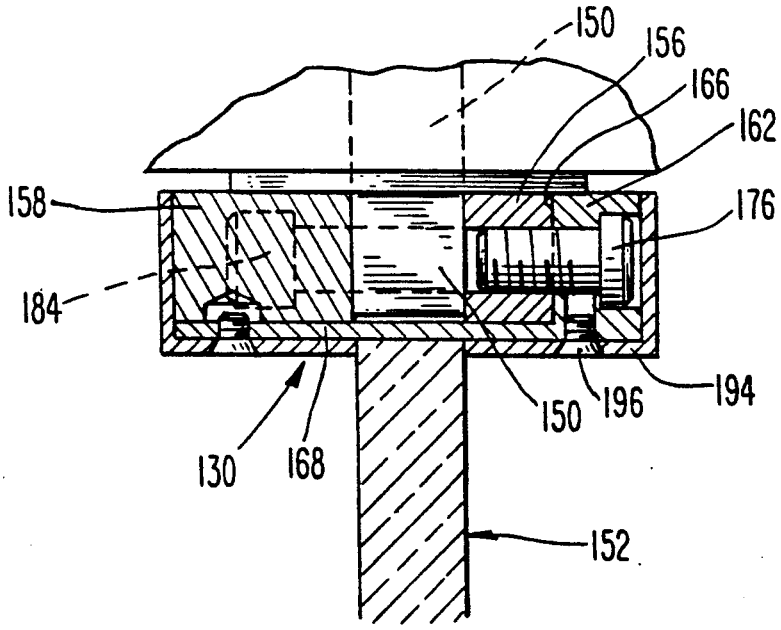
FIG. 11 is a left side cross-sectional view of the glass door assembly of FIG. 10 taken through the line 11—11, showing the detail of the upper hinging mechanism.

Referring to FIGS. 10 and 11, the hinging assembly 130 for use with an overhead closer mechanism is shown comprising a frame-supported collar member 154 which, through an insert 156 and a locking member 158, secures the door 152 (by way of the door frame 160) to the spindle 150 of a closer mechanism (not shown). The collar member 154, which comprises a shelf portion 168 (FIG. 11) and an arcuate portion 162 (FIG. 10) defined by inner and outer radial edge portions, 164 and 166, is shown attached to the door frame 160 with attachment means such as welds 170. The collar member 154 is provided on opposite lateral sides of the door 152, as shown in FIG. 11, to facilitate the support of the insert 156 and locking member 158, which during installation can rest on the shelf portion 168 of collar member 154. It is understood that other suitable means for attaching the collar member 154 can be employed with equal success for example the collar member 154 can be provided molded with the frame 160 to comprise an integral part thereof.

A slot 172 and tapered bore 174 (FIG. 10) are furnished in the frame-supported collar member 154. The insert 156 is provided to fit within the inner radial portion 166 of collar member 154 and is secured by a threaded bolt 176 which extends through the tapered bore 174 and into a threaded bore 178 of the insert 156. Once the insert 156 is secured to the collar member 154, the door 152 is then brought into position such that the closer spindle 150, which extends downwardly from the closer housed in the header 132 (FIG. 9), is received within the square slot 180 of the insert 156. The insert 156 is also provided with a pair of threaded bores 182 extending therethrough. Once the door is positioned so that the spindle 150 rests within the insert 156, the locking member 158 is then positioned on the shelf portion 168 of the collar member 154, and is next attached to the frame 160, via the insert 156, with bolts 184. The bolts 184 extend through bores 186 provided in of the locking member 158 and further extend through the threaded bores 182 of the insert 156 to bring the locking member 158 in engagement against the spindle 150 when tightened. Once the insert 156 and locking member 158 are secured in position, the assembly 130 surrounds the spindle 150 so that the door 152 may be rotated with the closer.

In addition, for added stability, a pair of threaded set screws 190 shown in FIG. 10 are provided to be received in threaded bores 192 which are disposed in the collar member 154. The screws 190 are tightened against the locking element 158 in order to provide a more even distribution of the force load transmitted by the spindle 150 on the door 152 during rotation.

Referring to the embodiment shown in FIGS. 10 and 11, adjustment of the door 152 within a doorway can be achieved by adjusting the position of the insert 156 which holds the spindle 150. This is achieved by positioning the retaining bolt 176 at any of a variety of locations along the slot 172. Once the adjustment is made and the door 152 is properly aligned, the set screws 190 can then be adjusted accordingly to accommodate for any change in the position of the insert 156 and locking element 158, as determined by the installation of the bolt 176 within the slot 172 and bore 173.

In addition, cover members 194, are provided to hide the components of the hinging assembly 130 in order to present a more aesthetically pleasing appearance. The cover members 194 can be installed with the set screws 196, as shown in FIG. 11.

Figure 12:
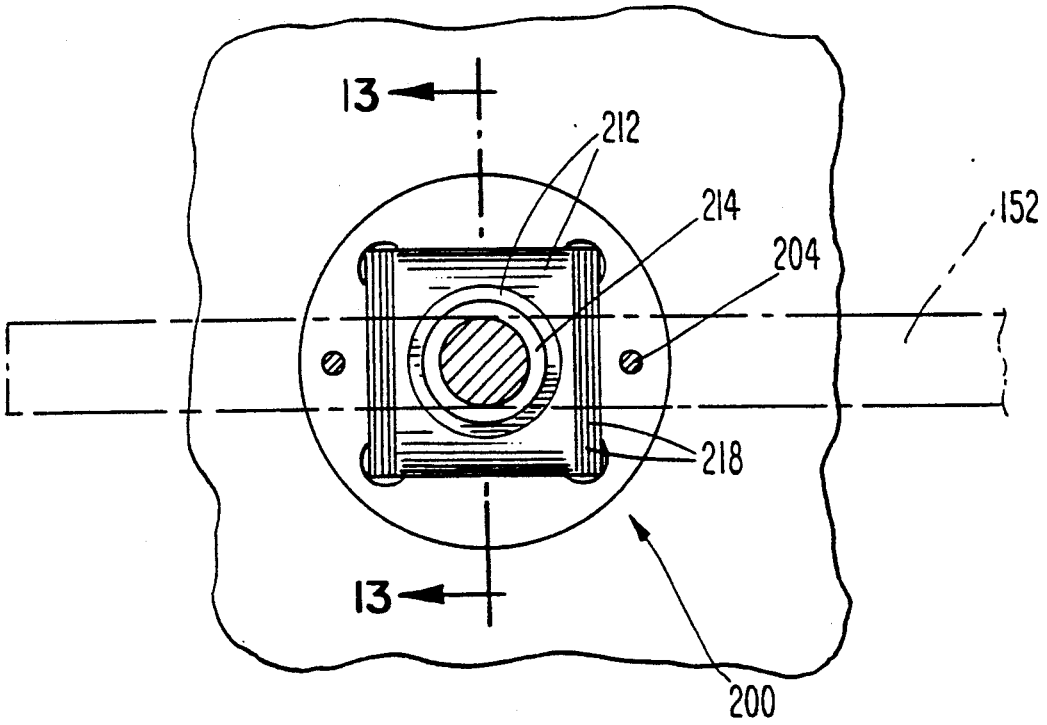
FIG. 12 is an enlarged top view of the lower hinging mechanism of the glass door assembly of FIG. 9, taken along the line 12—12.

Referring once again to FIG. 9, the lower hinging assembly 200 is shown employed in connection with a door 152 which is adapted for use with an overhead closer mechanism. The lower hinging assembly 200 is seen installed below the floor 418 (shown in phantom) and is hidden from view in normal use with a cover member 202 which can be secured in position with screws 204 (FIG. 12). The cover member 202 for example can be provided in section with an appropriate center cut-out 206 (FIG. 13) for accommodating the lower pivot member 208 of the door 152 which is shown extending below the floor 418, into the lower hinging assembly 200.

Figure 13:
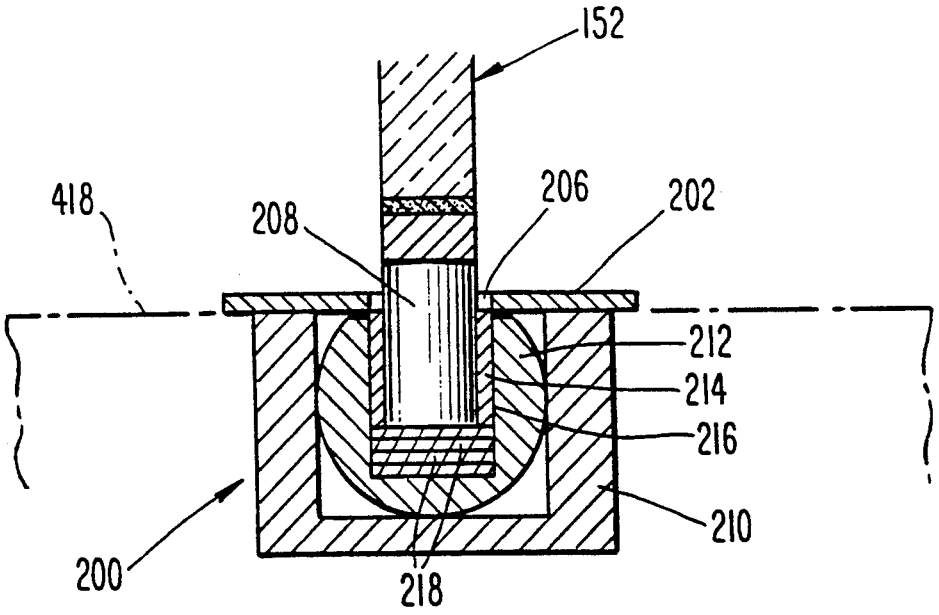
FIG. 13 is an enlarged left side cross-sectional view of the lower hinging mechanism of the glass door assembly of FIG. 9 taken along the line 13—13 of FIG. 12.

A cylindrical mounting base 210 is installed below the floor 418 and receives a tubular member 212 therein as best shown in FIG. 13. The tubular member 212 is provided to be positioned between the shims 218 seen in FIG. 12. The placement of shims 218 on either side of the tubular member 212 allows for lateral positioning and adjustment of the door 152 when being mounted. A bushing 214 in which the lower door pivot member 208 sits when mounted is received within a longitudinal bore 216 of the tubular member 212. Additional shims 218, can be prepositioned to accommodate the height of the door 152 during mounting.

The glass doors and hinging mechanism embodiments described herein can be employed in an arrangement incorporating sidelight panels, such as those shown in FIG. 1. This can be achieved by providing the header as an extended length of track whereby several doors and or sidelight panels may be installed.

This and other variations in the details of the system may be made in accordance with the invention, which is to be broadly construed and to be defined by the scope of the claims appended hereto.

I claim:

1. A glass door assembly comprising:

a) a glass door panel having a top edge, a bottom edge, and a pair of side edges, the panel edges defining the perimeter of the panel;

b) a frame portion disposed on at least two opposite panel edges, the frame portion being provided entirely outside of the perimeter of the glass panel;

c) a zone of bonding material provided between the frame portion and at least a portion of a perimetric panel edge along which a frame portion is disposed.

2. A glass door assembly of claim 1, further including upper and lower pivot means disposed on opposite door frame portions and extending outwardly from each frame portion.

3. The glass door assembly of claim 2, wherein each frame portion extends along the entire length of an edge of the glass panel.

4. The glass door assembly of claim 3, wherein the upper pivot means is provided having a cylindrical configuration, and wherein the lower pivot means is provided having a bar-like configuration.

5. The glass door assembly of claim 2, further comprising upper and lower hinging means, the upper hinging means being adapted to carry the upper pivot means therein and the lower hinging means being adapted to carry the lower pivot means therein.

6. The glass door assembly of claim 5, wherein the lower hinging means comprises an adapter member having a slot therein to receive the lower pivot means therein and having means which are carried within a door closer mechanism for rotating the door between opened and closed conditions with the closer mechanism.

7. The assembly of claim 5, further including a door closer mechanism provided beneath the glass door which is adapted to receive the lower pivot means therein.

8. The glass door assembly of claim 1, further comprising upper and lower hinging means, and an overhead closer mechanism having a spindle extending therefrom, wherein the upper hinging means comprises means for engaging the closer spindle to provide rotation of the glass door panel between open and closed conditions when the closer mechanism is operated.

9. A glass door assembly for use with an overhead door closer mechanism having a spindle extending therefrom, the door assembly comprising:

a) a door having top and bottom edges, a pair of side edges, and a frame portion disposed on at least two opposite edges of said door;

b) lower pivot means extending outwardly from the bottom door edge;

c) hinging means disposed on the top edge of the door for mounting the door to a closer mechanism located above the door; the hinging means including a collar member fixedly mounted to the top edge of the door, an insert, and a locking member, said collar member including a shelf portion for accommodating the insert and locking member, the hinging means further including first attachment means for connecting the insert to the collar member and second attachment means for connecting the locking member to the insert, the locking member and insert being provided at least in part on opposite sides of the closer spindle for securing the door to the closer spindle to provide rotation of the door between opened and closed conditions.

10. The assembly of claim 9, further including a header disposed above the door having a cavity therein for receipt of the door closer mechanism therein, wherein the door closer is provided with a spindle extending downwardly from the closer in relation to the door above which the closer and header are disposed, and wherein the hinging means for mounting the door to a closer comprises means for engaging and securing the closer spindle.

11. A method of installing a glass door in a doorway, comprising the steps of:

a) mounting a header above the doorway;

b) installing below the door sill of a doorway, a door closer mechanism which is adapted to carry the lower pivot member of a glass door;

c) installing on an upper pivot member of a glass door, a pivot block having a cut-out groove portion at each end thereof and a bore extending therethrough, including inserting the upper pivot member of the door into the pivot block bore;

d) positioning in the header, a generally "T"-shaped bar member;

e) installing on an upper pivot member of the glass door into a closer mechanism, including lifting the door with the pivot block into the header until the lower pivot member of the door is positioned over the closer mechanism which is adapted to receive the pivot member, and lowering the door into the closer mechanism;

f) placing a retaining block member into the header and sliding the block with the bar member over the pivot block; and g) securing the retaining block member to the bar member with securing means.

12. The method of claim 11, further including the step of installing a spring member between the pivot block and the retaining block member prior to securing the block and bar members with securing means.

13. The method of claim 11, further including the step of rotating the glass door an amount sufficient to expose the header assembly, in order to facilitate installation of the securing means.

14. A glass door assembly comprising:

a) a glass door panel having a top edge, a bottom edge, and a pair of side edges which define the perimeter of the panel;

b) a frame disposed on at least two opposite panel edges, the frame being provided outside of the perimeter of the glass panel; and c) a zone of bonding material provided between the frame portion and at least a portion of a perimetric panel edge along which a frame portion is disposed d) upper and lower hinging means, the upper hinging means being adapted for use with an overhead closer mechanism having a spindle extending therefrom, wherein the upper hinging means has means for securing the upper hinging means to be secured to the closer spindle to provide rotation of the glass door panel between open and closed conditions;

e) wherein the upper hinging mechanism comprises a collar member which is attached to a frame portion and extends laterally on opposite sides from the frame portion, the collar member having a shelf portion and an arcuate portion; an insert adapted to be received on the shelf portion of the collar member and secured thereto with insert securing means, the insert being further adapted to receive the closer spindle therein; and a locking member adapted to be secured to the insert with locking member securing means, to bring the insert and locking member together in engagement about the closer spindle.

15. The glass door assembly of claim 14, wherein the locking member securing comprises threaded bolts and matingly threaded apertures disposed in the insert to facilitate mounting of the locking member to the assembly.

16. The glass door assembly of claim 14, wherein at least one frame portion is provided with an outwardly extending pivot member; and wherein the lower hinging means comprises a cylindrical mounting base having a circumferential wall defining a cylindrical space therein; a tubular member having a longitudinally disposed bore therein which is adapted to receive the outwardly extending pivot member, the tubular member adapted to be secured within the cylindrical space of the mounting base.

17. The glass door assembly of claim 16, wherein adjustment means are provided for adjusting the position of the tubular member within the cylindrical space of the mounting base.

18. A glass door assembly comprising:

a) a glass door panel having a top edge, a bottom edge, and a pair of side edges which define the perimeter of the panel;

b) a frame disposed on at least two opposite panel edges, the frame being provided outside of the perimeter of the glass panel; and c) a zone of bonding material provided between the frame portion and at least a portion of a perimetric panel edge along which a frame portion is disposed;

d) upper and lower hinging means, the upper hinging means being adapted for use with an overhead closer mechanism having a spindle extending therefrom, wherein the upper hinging means is adapted to be secured to the closer spindle to provide rotation of the glass door panel between open and closed conditions; and e) means for adjusting the position of the glass door panel;

f) wherein the collar portion is provided with a threaded bore extending therethrough for receipt of means which engage the locking member to facilitate force distribution against the frame portion when the glass door panel is rotated.

19. A glass door assembly comprising:

a) a glass door panel having a top edge, a bottom edge, and a pair of side edges which define the perimeter of the panel;

b) a frame portion disposed on at least two opposite panel edge, the frame portion being provided entirely outside of the perimeter of the glass panel;

c) bonding material provided between the frame portion and at least a portion of a perimetric panel edge along which a frame portion is disposed;

d) upper and lower pivot means disposed on opposite door frame portions and extending outwardly from each frame portion;

e) upper and lower hinging means, the upper hinging means being adapted to carry the upper pivot means therein and the lower hinging means being adapted to carry the lower pivot means therein; and f) wherein the lower hinging means comprises an adapter member having a slot therein to receive the lower pivot means therein and having means which are carried within a door closer mechanism for rotating the door between opened and closed conditions with the closer mechanism.

20. The assembly of claim 19 further including a generally inverted "U"-shaped track member having mounting means for mounting the track to a mounting surface, wherein the upper hinging means includes securing means for securing the upper hinging means within the track member.

21. The assembly of claim 20, wherein the upper hinging means further comrises means for retaining the upper pivot means of the door frame, including means for pivotally carrying the upper pivot means of the door frame.

22. The assembly of claim 21, wherein the means for retaining the upper pivot member of the door frame comprises a generally "T"-shaped bar member which is adapted to be mounted within the track member, a retaining block member which is adapted to be secured to the bar member with securing means, and means for pivotally carrying the upper pivot means of the door frame including a pivot block having a cut-out groove portion at each end thereof for accommodating the securing means.

23. The assembly of claim 20, wherein the track member further comprises a header having a top wall and a pair of opposing side walls, each side wall having an inner and outer surface and extending from the top wall to define a channel therebetween; a pair of oppositely disposed protrusions which extend into the channel being provided on the inner surface of each sidewall, the protrusions defining an upper slot which is in part further defined by the top wall of the header; and wherein the upper hinging means further includes a generally "T"- shaped bar member which is adapted to be carried in the upper slot, a retaining block member which is adapted to be fastened to the "T"-shaped bar member with securing means, and a pivot block having a cut-out groove portion at each end thereof for accommodating the securing means, the pivot block having a slot therein for pivotally carrying the upper pivot means therein.

24. The glass door assembly of claim 23, wherein the upper hinging mechanism further includes a spring member disposed between the retaining block member and the pivot block, the spring member being adapted to be secured to the retaining block member with the securing means, and to bias the pivot block against the securing means.

25. The glass door assembly of claim 24, further comprising a generally "U"-shaped cover piece having a connecting wall and a pair of sidewalls extending from the connecting wall, the cover piece having retaining means at the terminal end of each sidewall for installation thereof within the upper slot of the header.

26. The assembly of claim 24, wherein the header is installed to be flush-mounted with a ceiling.

27. The glass door assembly of claim 20, further including a transom panel having upper and lower edge portions; a transom bar having top and bottom wall portions and a pair of opposing side wall portions, the transom bar being adapted to receive the track member and upper hinging mechanism carried therein, the transom bar further having a groove in its top wall portion which is adapted to receive the lower edge portion of a transom panel therein; and a second track member being provided in above relation to the transom bar and being adapted to secure the upper edge portion of the a transom panel therein.

28. A glass door assembly comprising:

a) a glass door panel having a top edge, a bottom edge, and a pair of side edges which define the perimeter of the panel;

b) a frame portion disposed on at least two opposite panel edges, the frame portion being provided entirely outside of the perimeter of the glass panel;

c) bonding material provided between the frame portion and at least a portion of a perimetric panel edge along which a frame portion is disposed;

d) upper and lower pivot means disposed on opposite door frame portions and extending outwardly from each frame portion;

e) upper and lower hinging means, the upper hinging means being adapted to carry the upper pivot means therein and the lower hinging means being adapted to carry the lower pivot means therein; and f) a door closer mechanism provided beneath the glass door which is adapted to receive the lower pivot means therein.

29. A glass door assembly comprising:

a) a glass door panel having a top edge, a bottom edge, and a pair of side edges which define the perimeter of the panel;

b) a frame portion disposed on at least two opposite panel edges, the frame portion being provided entirely outside of the perimeter of the glass panel;

c) bonding material provided between the frame portion and at least a portion of a perimetric panel edge along which a frame portion is disposed;

d) upper and lower hinging means; and an overhead closer mechanism having a spindle extending therefrom, wherein the upper hinging means comprises means for engaging the closer spindle to provide rotation of the glass door panel between open and closed conditions when the closer mechanism is operated.

30. The glass door assembly of claim 29, further including means for adjusting the position of the glass door panel.

31. A method of installing a glass door in a doorway comprising the steps of:

a) mounting a header along with a closer mechanism above the doorway;

b) installing below the door sill of a doorway, a lower hinging means which is adapted to rotatably carry the lower pivot member of a glass door;

c) providing a glass door including a glass panel having at least upper and lower frame portions attached to the panel by a zone of adhesive disposed between each frame portion and glass panel edge which it borders, wherein a collar member having an arcuate-walled portion and a shelf portion is attached to the frame, d) installing an insert member on the shelf portion within the arcuate portion;

e) tilting the glass door at an angle and positioning the lower pivot member of the glass door into a lower hinging mechanism;

f) tilting the glass door to a vertical position such that a spindle extending from the closer is engaged by the insert;

g) installing a locking member on the insert to maintain the spindle therebetween in engagement with the insert and the locking member.

* * * * *